US005657983A

United States Patent [19]

Fisk

[11] Patent Number: 5,657,983

[45] Date of Patent: Aug. 19, 1997

[54] WEAR RESISTANT REGISTRATION EDGE GUIDE

[75] Inventor: Duane H. Fisk, Whitesville, N.Y.

[73] Assignee: Xerox Corporation, Stamford, Conn.

[21] Appl. No.: 583,908

[22] Filed: Jan. 11, 1996

[51] Int. Cl.[6] ..... B65H 9/16

[52] U.S. Cl. ..... 271/251; 271/248

[58] Field of Search ..... 271/248–252, 271/236, 238

[56] References Cited

U.S. PATENT DOCUMENTS

| | | | |
|---|---|---|---|
| 4,616,553 | 10/1986 | Nixon | 242/157.1 |
| 4,676,498 | 6/1987 | Kanemitsu et al. | 271/251 |
| 4,775,142 | 10/1988 | Silverberg | 271/251 |
| 5,390,909 | 2/1995 | Herrick | 271/248 |

FOREIGN PATENT DOCUMENTS

| | | | |
|---|---|---|---|
| 405032357 | 2/1993 | Japan | 271/251 |

*Primary Examiner*—H. Grant Skaggs
*Attorney, Agent, or Firm*—Denis A. Robitaille

[57] ABSTRACT

A lateral sheet registering device for registering sheets transported along a predetermined path including a lateral registration edge positioned along the path. An active lateral registration apparatus urges sheetlike material into contact with a registration edge guide member as the material is advanced in a process direction of travel. A wear resistant contact surface is provided along an inboard side of the registration edge guide by mounting a plurality of dowel pins fabricated from a particularly wear resistant material along the registration edge guide. The dowel pins are mounted so as to be rotatable and/or replaceable without the requirement of replacing the registration edge guide or removing the sheet handling system.

10 Claims, 3 Drawing Sheets

WEAR RESISTANT REGISTRATION EDGE GUIDE

The present invention relates generally to a Sheet handling and registration system for transporting and aligning a copy substrate in an electrostatographic printing machine, and more particularly concerns an improved registration edge guide having replaceable wear resistant insert members for extending the life of a sheet handling and registration system.

Generally, the process of electrostatographic copying is initiated by exposing a light image of an original document onto a substantially uniformly charged photoreceptive member. Exposing the light image onto the charged photoreceptive member discharges a photoconductive surface thereof in areas corresponding to non-image areas in the original document while maintaining the charge in image areas, thereby creating an electrostatic latent image of the original document on the photoreceptive member. Thereafter, developing material comprising charged toner particles is deposited onto the photoreceptive member such that the toner particles are attracted to the charged image areas on the photoconductive surface to develop the electrostatic latent image into a visible image. This developed image is then transferred from the photoreceptive member, either directly or after an intermediate transfer step, to an image support substrate such as a copy sheet, creating an image thereon corresponding to the original document. The transferred image is typically affixed to the image support substrate to form a permanent image thereon through a process called "fusing". In a final step, the photoconductive surface of the photoreceptive member is cleaned to remove any residual developing material thereon in preparation for successive imaging cycles.

The electrostatographic copying process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

Sheet handling devices are commonly used in printing systems, and, in particular, electrostatographic printing machines of the type described hereinabove, as well as image input scanning devices and the like, for transporting sheet material to predetermined locations required for accomplishing the printing process. Such sheet handling devices are generally referred to in two categories: document handlers, which are used to transport sheets of image bearing support material such as, for example, vellum, paper and the like, for scanning or imaging thereof; and copy sheet handlers, which transport sheets of similar image support material which, in general at least initially, are not image bearing, for transfer of an image thereto. Printers, duplicators and copiers commonly employ both types of sheet handling devices to transport sheets to and from an image reproduction or imaging subsystem, such as an image input scanning station, and/or an image imprinting subsystem, such as a transfer station. Image input devices which include scanners, optical character readers and the like, also employ sheet handling devices of the type to which this invention relates.

In systems employing such sheet handling devices, maintaining proper alignment of the image support sheet along the transport path thereof so as to inhibit skew of the sheet being transported is an important function required to provide acceptable performance. For example, in a typical electrostatographic printing machine employing a copy sheet handler, inhibiting the skew of a transported sheet to provide proper registration of the sheet as it passes through the transfer station is necessary for producing an acceptable output copy sheet wherein the image imparted thereto is properly centered and aligned on the copy sheet. Failure to provide proper registration of a copy sheet in a copy sheet handler will generally result in unacceptable image transfer to the copy sheet, such as skewed images, images extending off of the edge of the sheet and similar problems. Likewise, failure to control skewing and registration of input documents in a document handler will also result in the image produced therefrom to be similarly affected. In addition to misimaging of the sheet, misalignment failures can also cause jams and other similar paper transport problems. Thus, in sheet transport devices, such as document feeders and automatic or semiautomatic document handlers, as well as copy sheet feeders, proper control of the alignment and registration of the sheet is an important and essential system requirement.

Many devices and techniques have been developed and utilized to provide proper registration of sheets. One simple solution is the placement of side or lateral registration edges in the loading areas of the sheets to be fed. In addition, active registering devices, such scuffer rollers, cross-rolls and the like have been used to achieve satisfactory results. In most cases, sheets are transported in the general proximity of a fixed edge member or so-called registration edge guide with the active registering device forcing the sheet against the registration edge guide to provide proper alignment thereof. Many forms of apparatus and devices of this nature have been successfully employed for providing registration of sheets and/or documents transported in sheet handling devices, such as those systems disclosed in U.S. Pat. Nos. 4,621,801; 4,836,527; and 5,065,998, among others.

It has been found, however, that in systems which are intended to register a sheet against a lateral registration edge guide, wherein the sheet is transported in a process direction of travel while being urged against a registration edge guide during transport thereof, excessive wear of the registration edge guide often occurs. Indeed, in a typical machine, the registration edge guide is provided in the form of a molded plastic element, wherein paper, which may represent a highly abrasive material when moving at high speeds, causes a groove to be cut into the plastic registration edge guide which may induce misregistration of sheets, paper jams and resultant machine failures. In fact, in many applications, where usage rates are on the order of hundreds of thousands of prints per month, the registration edge guide may start to show fatigue within 50,000 copies, leading to machine failures on a bimonthly basis. This problem can be exacerbated by the use of heavier weight sheets such as label bearing sheets as well as vellum materials and the like, wherein increased drive forces are typically generated on the heavier sheets by the active registration devices. That is, for example, in the case of nonadjustable cross rollers, the normal force imparted on the copy sheet in the nip tends to increase as the sheets become thicker, such that the drag or frictional force generated by the heavier weight sheets along the lateral registration edge guide also tends to be greater.

Various types of registration edge guide members and registration systems have been designed to address the problem of wear. For example, registration edge guides fabricated from cross grain tempered or hardened stainless steel have been incorporated into various machines in the marketplace. It has been found that stainless steel will extend the life of the registration edge by approximately four to six times. However, once the hardness depth of the stainless steel is worn through as a result of frictional forces, failure follows in relatively short order. Although such registration edge guides are more durable than plastic versions, they are obviously more expensive and still fall short of machine life expectations. Thus, there exists a need to overcome this type of problem.

In accordance with one aspect of the present invention, there is provided an apparatus for registering a sheet material moving along a process direction of travel, comprising: a registration edge guide member defining a surface substantially parallel to the process direction of travel; means for driving the sheet material laterally relative to the process direction of travel, to urge the sheet material against the registration edge guide member to provide proper alignment and registration of the sheet material; and a wear resistant contact surface positioned along an inboard surface of the registration edge guide member, for providing a wear resistant surface against which the sheet material is urged to eliminate excessive wear of the registration edge guide member.

Pursuant to another aspect of the present invention, there is provided a sheet material transport device for advancing sheet material in a process direction of travel, including an apparatus for registering the sheet material, comprising: a registration edge guide member defining a surface substantially parallel to the process direction of travel; means for driving the sheet material laterally relative to the process direction of travel, to urge the sheet material against the registration edge guide member to provide proper alignment and registration of the sheet material; and a wear resistant contact surface positioned along an inboard surface of the registration edge guide member, for providing a wear resistant surface against which the sheet material is urged to eliminate excessive wear of the registration edge guide member.

A preferred embodiment of the invention is also disclosed, wherein the wear resistant contact surface includes at least one dowel pin member which is fabricated from a ceramic material and mounted on the registration edge guide member for providing the wear resistant surface against which the sheet material is urged. In the preferred embodiment, the registration edge guide includes a receiving aperture for mounting the dowel pin member therein, and a spring clip member for exerting a force against the dowel pin member mounted in the receiving aperture such that a surface of the dowel pin member extends a predetermined dimension beyond the inboard surface of the registration edge guide member.

Other aspects of the present invention will become apparent as the following description proceeds and upon reference to the drawings, wherein like reference numerals have been used throughout to identify identical or similar elements, in which.

While the present invention will hereinafter be described in connection with a preferred embodiment and method of use, it will be understood that this description is not intended to limit the invention to that embodiment or method of use. On the contrary, the following description is intended to cover all alternatives, modifications, and equivalents, as may be included within the spirit and scope of the invention as defined by the appended claims. For example, although the invention is described in the context of a copy sheet handling system for delivering sheets to a transfer station, the invention has equal application in a document sheet handling system or any other system in which it is important to register sheetlike material while delivering the material to another location. Other aspects and features of the present invention will become apparent as the description progresses.

Figure 3:
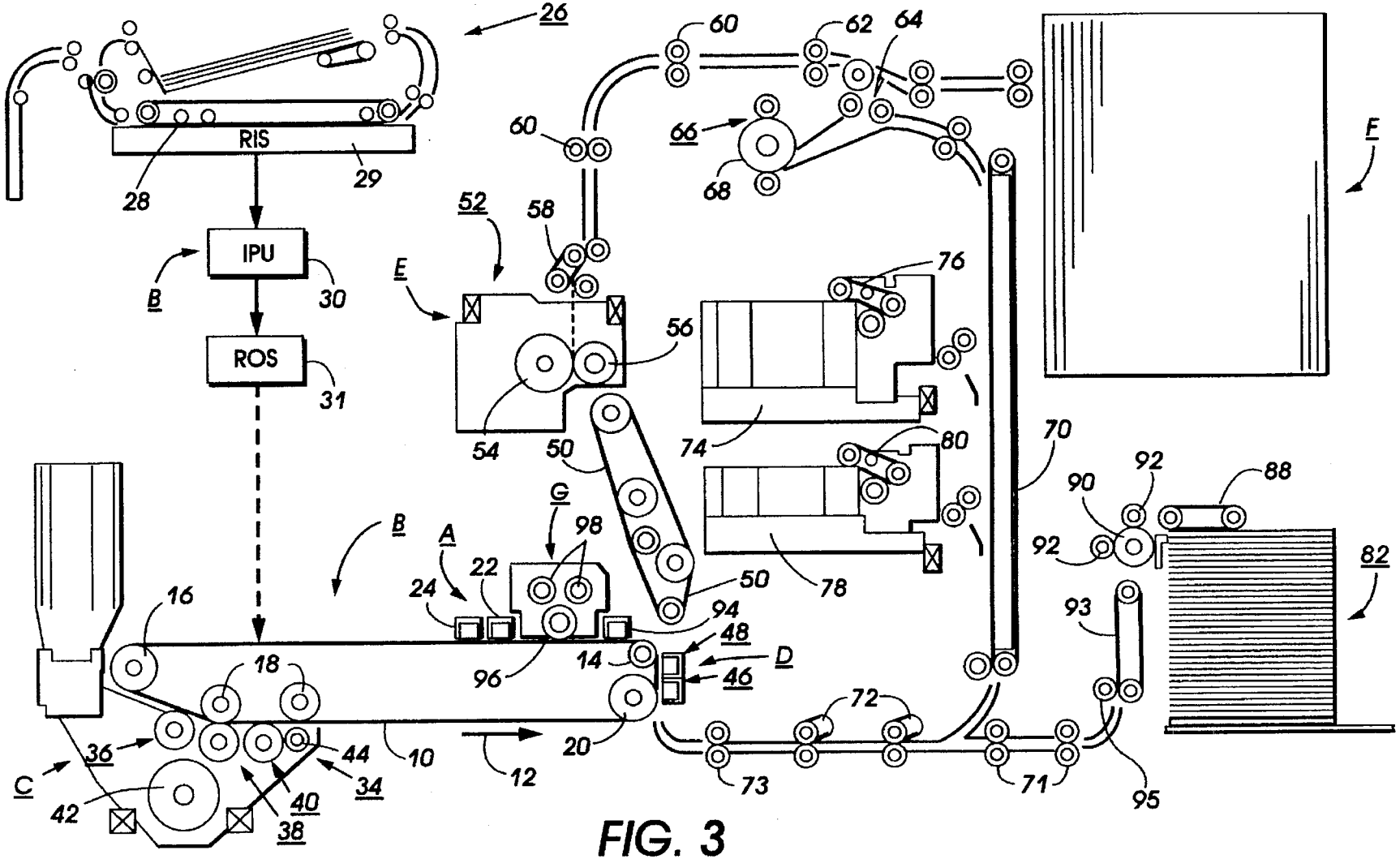
FIG. 3 is a schematic elevational view depicting an illustrative electrostatographic printing machine incorporating a document registration edge guide in accordance with the present invention.

Turning initially to FIG. 3 prior to discussing the invention in detail, a schematic depiction of an exemplary electrostatographic reproducing machine incorporating various machine systems is furnished in order to provide a general background and understanding of the features of the present invention. Although the apparatus of the present invention is particularly well adapted for use in an automatic electrostatographic printing machine as shown in FIG. 3, it will become apparent from the following discussion that the registration edge guide of the present invention is equally well suited for use in a wide variety of electrostatographic processing machines as well as many other known printing systems. It will be further understood that the present invention is not necessarily limited in its application to the particular embodiment or embodiments shown and described herein. In particular, although the present invention will be described in the context of a pretransfer system, wherein a copy sheet is transported and aligned in preparation for transport into a transfer subsystem so that an image can be transferred thereto, the invention may also be adapted for use in a document handling system of the type in which an image bearing substrate is transported onto an imaging platen for producing a copy thereof.

The exemplary electrostatographic printing machine of FIG. 3 employs a photoconductive belt 10, preferably comprising a photoconductive material coated on a ground layer, which, in turn, is coated on an anti-curl substrate. Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under a desired tension. Drive roller 20 is rotated by a motor (not shown) coupled thereto by any suitable means such as a drive belt. Thus, as roller 20 rotates, it advances belt 10 in the direction of arrow 12 to advance successive portions of the photoconductive surface sequentially through the various processing stations disposed about the path of movement thereof.

Initially, a portion of photoconductive belt 10 passes through charging station A whereat two corona generating devices, indicated generally by the reference numerals 22 and 24 charge photoconductive belt 10 to a relatively high, substantially uniform potential. This dual or "split" charging system is designed so that corona generating device 22 places all of the required charge on photoconductive belt 10 while corona generating device 24 acts as a leveling device to provide a uniform charge across the surface of the belt. Corona generating device 24 also fills in any areas missed by corona generating device 22.

Next, the charged portion of photoconductive belt 10 is advanced through imaging station B. At imaging station B, a document handling unit, indicated generally by reference numeral 26, is positioned over platen 28 of the printing machine. The document handling unit 26 sequentially feeds documents from a stack of documents placed in a document stacking and holding tray such that the original documents to be copied are loaded face up into the document tray on top of the document handling unit. Using this system, a document feeder, located below the tray, feeds the bottom document in the stack to rollers for advancing the document onto platen 28 by means of a belt transport which is lowered onto the platen with the original document being interposed between the platen and the belt transport. When the original document is properly positioned on platen 28, the document is imaged and the original document is returned to the document tray from platen 28 by either of two paths. If a simplex copy is being made or if this is the first pass of a duplex copy, the original document is returned to the document tray via a simplex path. If this is the inversion pass of a duplex copy, then the original document is returned to the document tray through a duplex path.

Imaging of the document is achieved by a scanning assembly, preferably comprising a Raster Input Scanner (RIS) 29 for capturing the entire image from the input document and converting the image into a series of raster scan lines corresponding to individual picture elements or so-called pixels making up the original input document. The output signal of the RIS 29 is transmitted as an electrical signal to an Image Processing Unit (IPU) 30 where they are converted into an individual bitmap representing the receptive values of exposure for each pixel. The IPU 30 can store bitmap information for subsequent imaging or can operate in a real time mode. The digital output signal generated by the IPU 30 is transmitted to a Raster Output Scanner (ROS) 31 for writing the image bitmap information onto the charged photoreceptive belt 10 by selectively erasing charges thereon in a pixel-by-pixel manner. It should be noted that either discharged area development (DAD) discharged portions are developed, or charged area development (CAD), wherein charged areas are developed can be employed, as known in the art. This process records an electrostatic latent image on photoconductive belt 10 corresponding to the informational areas contained within the original document. Thereafter, photoconductive belt 10 advances the electrostatic latent image recorded thereon to development station C.

At development station C, a magnetic brush developer housing, indicated generally by the reference numeral 34, is provided, having three developer rolls, indicated generally by the reference numerals 36, 38 and 40. A paddle wheel 42 picks up developer material in the developer housing and delivers the developing material to the developer rolls. When the developer material reaches rolls 36 and 38, it is magnetically split between the rolls with approximately half of the developer material being delivered to each roll. Photoconductive belt 10 is partially wrapped about rolls 36 and 38 to form an extended development zones. Developer roll 40 is a cleanup roll and magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet (not shown) is moved into contact with the toner powder image on belt 10. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray 84 to transfer station D, via vacuum feed belt 88 which feeds successive uppermost sheets from the stack to a take away roll 90 and rolls 92. The take-away roll 90 and rolls 92 guide the sheet onto transport 93. Transport 93 and roll 95 advance the sheet to rolls 71 which, in turn, move the sheet toward transfer station D.

Copy sheets may also be fed to transfer station D from a secondary tray 74 or auxiliary tray 78, which includes an elevator driven by a bidirectional AC motor and a controller having the ability to drive the tray up or down. When the tray is in the down position, stacks of copy sheets are loaded thereon or unloaded therefrom. In the up position, successive copy sheets may be fed therefrom by a sheet feeder 76 or 80 comprising a friction retard feeder utilizing a feed belt and take-away rolls to advance successive copy sheets to transport 70 which advances the sheets toward transfer station D. It will be recognized that secondary tray 74 and auxiliary tray 78 represent supplemental sources of copy sheets.

As previously discussed, it is important that proper alignment of the copy sheet is maintained along the transport path thereof so as to inhibit skew of the sheet being transported and to provide proper alignment and registration of sheets transported through the transfer station as necessary for producing an output copy sheet in which the image imparted thereto is properly centered and aligned on the copy sheet. Failure to provide proper registration of a copy sheet will generally result in unacceptable image transfer to the copy sheet, such as images that are not in alignment with the copy sheet edge, so-called skewed images, images extending off of the edge of the sheet, and similar misimaging problems, as well as paper jams and substrate misfeed failures. In response to this problem, a pair of de-skew rollers or similar active registration device, indicated schematically by reference numeral 72, are provided in combination with a lateral registration edge guide (shown in FIGS. 1 and 2) situated along the lateral edge of the sheet transport path. In this system, sheets are generally transported in proximity to and in the direction of the registration edge guide by means of the de-skew rollers or similar active registering device which urges the sheet against the lateral registration edge guide to provide proper alignment thereof. Many forms of apparatus and devices of the type described have been successfully employed for providing registration of sheets in an electrostatographic printing machine, as evidenced by the previously referenced prior art as well as various other patents and publications. Further details of a registration edge guide in accordance with the present invention will be described hereinafter with reference to FIGS. 1 and 2.

Continuing now with a general description of the electrostatographic printing process, the developed image on belt 10 contacts the advancing sheet of support material in a timed sequence and is transferred thereon at transfer station D. As can be seen in the illustrated embodiment, a corona generating device 46 charges the copy sheet to a proper potential so that the sheet is electrostatically secured or "tacked" to belt 10 and the toner image thereon is attracted to the copy sheet. After image transfer, a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting the copy sheet to fusing station E.

Fusing station E includes a fuser assembly, indicated generally by the reference numeral 52, which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller 56 abuts the fuser roller 54 to provide the necessary pressure to fix the toner powder image to the copy sheet. In this fuser assembly, the fuser roll 54 is internally heated by a quartz lamp while a release agent, stored in a reservoir, is pumped to a metering roll which eventually applies the release agent to the fuser roll.

After fusing, the copy sheets are fed through a decurling apparatus 58 which bends the copy sheet in one direction to put a known curl in the copy sheet, thereafter bending the copy sheet in the opposite direction to remove that curl, as well as any other curls or wrinkles which may have been introduced into the copy sheet. The copy sheet is then advanced, via forwarding roller pairs 60 to duplex turn roll 62. A duplex solenoid gate 64 selectively guides the copy sheet to finishing station F or to inverter 66. In the finishing station, the copy sheets are collected in sets and the copy sheets of each set can be stapled or glued together. Alternatively, duplex solenoid gate 64 diverts the sheet into inverter 66, providing intermediate storage for one sheet which has been printed on one side and on which an image will be subsequently printed on the second, opposed side thereof, i.e. the sheet being duplexed. In order to complete duplex copying, the simplex sheet in inverter 66 is fed by a feed roll 68 from inverter 66 back to transfer station D for transfer of the toner powder image to the opposite side of the copy sheet.

Invariably, after the the copy sheet has been separated from photoconductive belt 10 subsequent to image transfer therefrom, some residual particles remain attached to the surface of the belt 10. As a result, photoconductive belt 10 passes beneath yet another corona generating device 94 which charges the residual toner particles to the proper polarity for breaking the bond between the toner particles and the belt. Thereafter, a pre-charge erase lamp (not shown), located inside the loop formed by photoconductive belt 10, discharges the photoconductive belt in preparation for the next charging cycle. Residual particles are removed from the photoconductive surface at cleaning station G. Cleaning station G includes an electrically biased cleaner brush 96 and two waste and reclaim de-toning rolls 98. One reclaim roll 98 is electrically biased negatively relative to the cleaner roll 96 so as to remove toner particles therefrom while the other reclaim roll 98 is electrically biased positively relative to the cleaner roll 96 so as to remove paper debris and wrong sign toner particles. The toner particles on the reclaim roll 98 are scraped off and deposited in a reclaim auger (not shown), where they are transported out of the rear of cleaning station G.

The various machine subsystems described hereinabove are typically regulated by an electronic subsystem (ESS) (not shown) which is preferably a controller such as a programmable microprocessor capable of managing all of the machine functions. Among other things, the controller provides a comparison count of the copy sheets, the number of documents being recirculated, the number of copy sheets selected by the operator, time delays, jam indications and subsystem actuation signals. Conventional sheet path sensors or switches may be utilized to keep track of the position of documents and the sheets in the machine. In addition, the controller regulates the various positions of gates and switching depending upon the mode of operation selected.

The foregoing description should be sufficient for the purposes of the present application for patent to illustrate the general operation of an electrostatographic printing apparatus incorporating the features of the present invention. As previously discussed, the electrostatographic reproducing apparatus may take the form of any of several well known systems including various printing and copying machines manufactured by Xerox Corporation. Variations of specific electrostatographic processing subsystems or processes may be expected without affecting the operation of the present invention.

Figure 1:
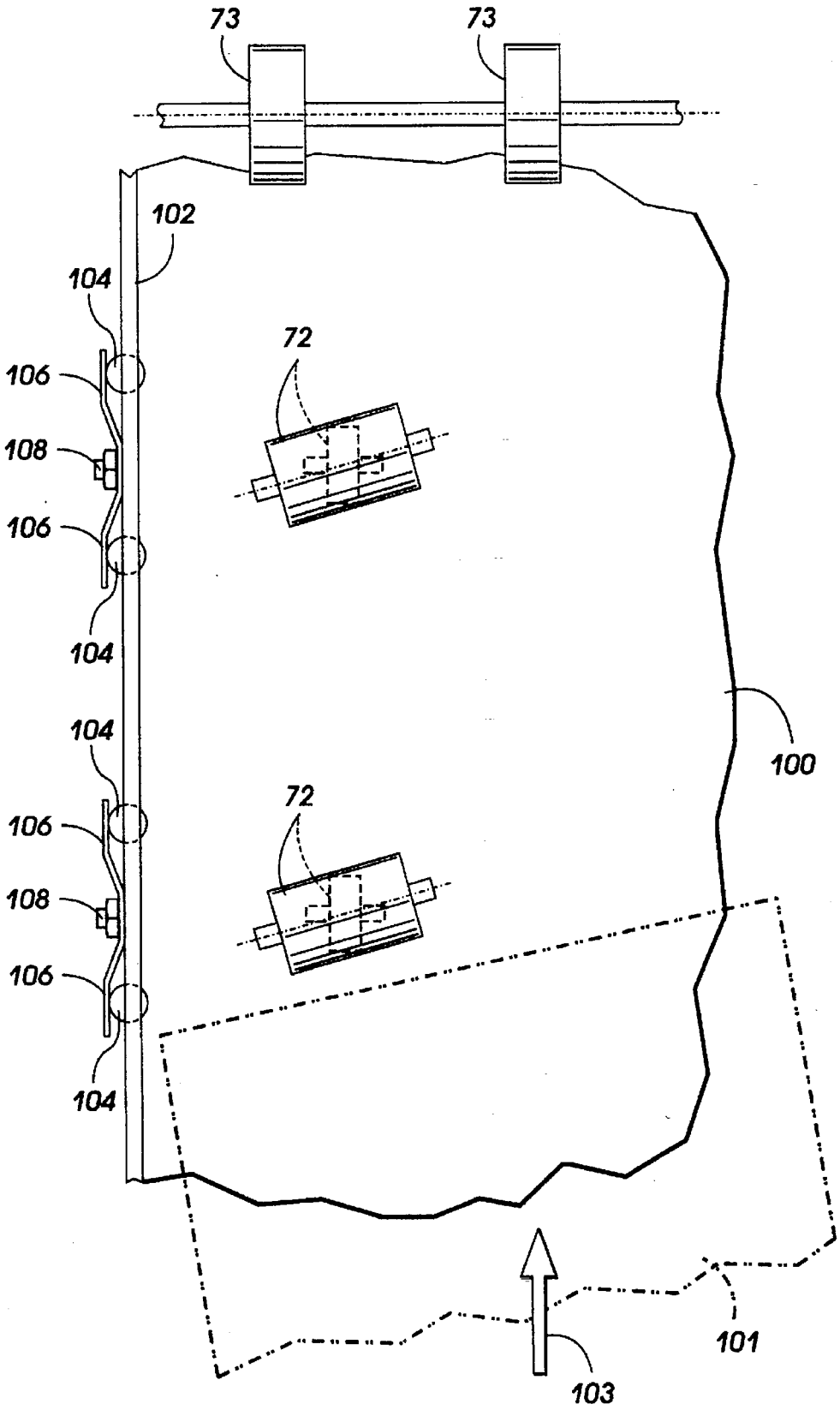
FIG. 1 is a plan view of a sheet handling system illustrating a typical cross roll-type active registration system wherein a sheet is urged against a registration edge guide.
Figure 2:
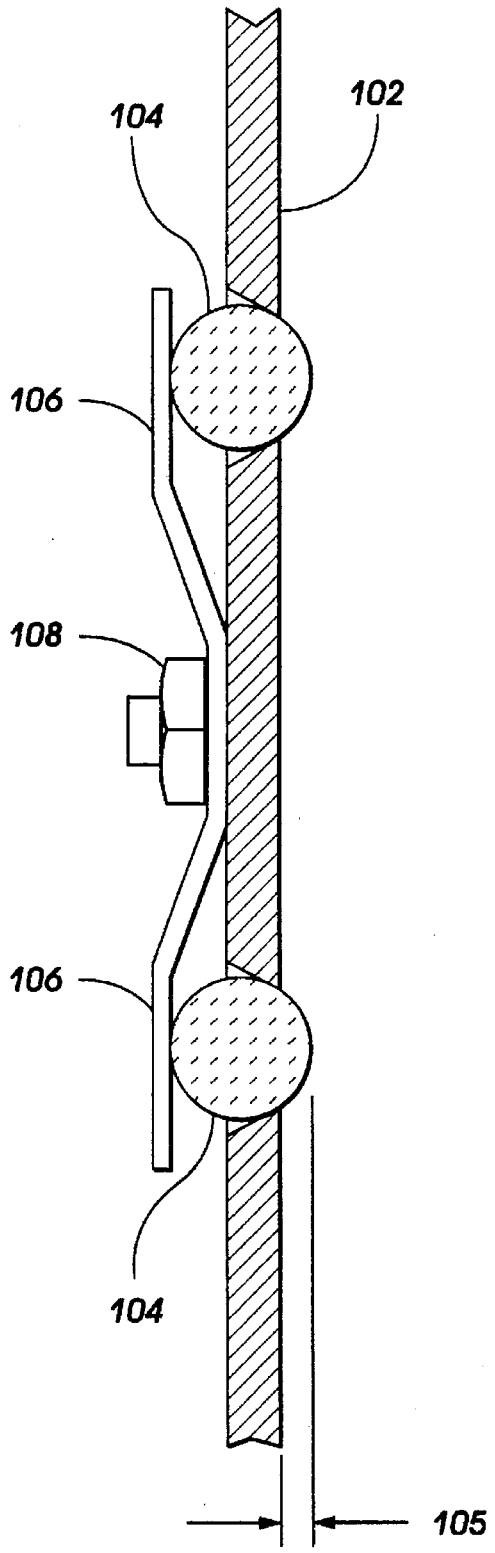
FIG. 2 is an enlarged plan view of the sheet handling system of FIG. 1.

Moving now to FIGS. 1 and 2, the particular features of the wear resistant document registration edge guide of the present invention will be described in greater detail with respect to the copy sheet transport and registration apparatus located just prior to the machine transfer system for delivering copy sheets thereto in registered configuration. With specific reference to FIG. 1, the copy sheet transport and registration system is depicted in plan view to more clearly reveal the operation thereof as well as the various components included therein. As depicted at FIG. 1, the copy sheet transport and registration system is provided in the form of a single sheet feeder comprised of a sheet input tray 100 having a lateral registration edge guide 102 situated along one side thereof, wherein transport and registration of copy sheets is accomplished by de-skew rollers 72 arranged for urging the copy sheet material against the lateral registration edge guide 102 while simultaneously advancing the copy sheet along a predetermined path defined by the sheet input tray 100. The sheet input tray 100 and registration edge guide 102 are typically integral to the machine, forming a portion of the sheet feeding assembly of the entire copy substrate handling system.

In operation, a copy sheet, generally identified by reference numeral 101, is delivered to the sheet input tray 100 along a process direction of travel indicated by arrow 103. As depicted in FIG. 1, the copy sheet 101 may arrive at the sheet input tray 100 having a side edge which is angularly offset or skewed from the defined process direction of travel 103 and/or not in alignment with the registration edge guide 102. Proper alignment or so-called registration of the copy sheet 101 is accomplished through the use of an active registration device, such as, for example, a cross roller device, as shown, wherein rollers 72 generally contact each other in the sheet path to form a nip through which the copy sheet material passes. Transport of the copy sheet material is accomplished by a drive means, such as a motor (not shown) suitably connected to one of the rollers 72 for inducing rotational movement thereof which, in turn, induces transport movement of the copy sheet passing therebetween. The rollers 72 are situated at an angle relative to each other and relative to the process direction of travel 103 for urging the copy sheet 101 passing therethrough in a lateral direction toward the registration edge guide 102. An appropriate limited sideways or lateral vector force component is exerted against the copy sheet 101 by the frictional forces of the angularly off-set de-skew rollers 72. The lateral vector force component generated by de-skew rollers 72 continuously urges the copy sheet 101 passing therethrough toward the registration edge guide 102 until the edge of the copy sheet 101 is fully abutting the registration edge guide 102 which is situated parallel to the process direction of travel 103 of the copy sheets. The registration edge guide 102 includes a generally smooth inboard surface for providing a low resistance, low friction sidewall against which one edge of each copy sheet 101 is contacted as it is being advanced through rollers 72 for de-skewing and side-registering the copy sheet 101. Thus, each copy sheet 101 is accurately side-registered just prior to delivery to the image transfer station. All de-skewing is accomplished in the sheet input tray 100 such that additional transport rollers, as for example rollers 73, need only provide linear transport of the copy sheet 101 without inducing any uncorrectable gross side misregistration or skewing thereof.

Thus, FIG. 1 depicts a typical cross roller system, wherein a pair of rollers, arranged to have a normal force between them for advancing a sheetlike material passing therethrough along a process direction of travel, are also angularly offset with respect to one another for inducing a lateral force on the sheetlike material, thereby urging the sheetlike material laterally against a fixed registration edge guide. Optimally, the lateral force exerted against the sheetlike material by the cross rollers is sufficient to move the document toward and against the registration edge guide while providing a high ratio of forward driving force on the copy sheet relative to the lateral force exerted thereagainst. Variations to the cross roller device described herein, in which nipped cross rollers with opposing skews are used for side registration into an edge guide in a document path are disclosed in U.S. Pat. No. 4,621,801 as well as other references cited therein including U.S. Pat. Nos. 4,316,667; 4,432,541; and 4,179,117, among others. In addition, various other types of active registration systems and devices wherein sheetlike material is urged against a registration edge guide are also known and may be incorporated into the present invention.

Moving now to the specific problem addressed by the present invention, it is noted that as xerographic and other copying systems increase in speed and become more automated, it is increasingly important to provide higher speed, more reliable and more automated copy sheet transport and handling systems. Likewise, it has become increasingly important to transport and accurately register copy sheets as well as document sheets of a variety or mixture of sizes, types, weights and materials, while minimizing failure conditions such as document jamming, misalignment, or damage to the copy sheet due to the sheet transport and registration apparatus. However, with the advent of such high speed and multi-substrate capacity systems, excessive wear of the registration edge guide 102 is common due to the highly abrasive interactive forces created between the registration edge guide 102 and the copy sheet 101 being transported thereagainst.

The present invention provides a low cost solution to this problem by providing the registration edge guide 102 with a wear resistant contact surface against which the copy sheet is urged while being advanced in the process direction of travel in tray 100. In a preferred embodiment of the invention, as shown in FIGS. I and 2, this wear resistant contact surface is furnished by introducing, along the inboard surface of the registration edge guide 102, a plurality of dowel pins 104 fabricated from a particularly wear resistant material, such that the contact surface along the inboard edge of the registration edge guide 102 is the surface of the dowel pins 104. As shown in FIG. 1, and in greater detail in FIG. 2, the mounting of the dowel pins 104 is facilitated by providing the registration edge guide 102 with a plurality of receiving apertures, wherein each receiving aperture holds a respective dowel pin 104. Each dowel pin 104 is further secured within the receiving aperture by means of a spring clip 106 fastened to the outboard side of the registration edge guide 102 via a threaded screw or nut fastener 108, wherein the spring clip exerts a force against the dowel pin 104 such that the contact surface of the dowel pin 104 extends by a predetermined dimension 105 beyond the inboard side of the registration edge guide 102.

In a preferred embodiment of the present invention, as shown in FIG. 1, a total of four standard 9.5 mm×12 mm dowel pins 104 fabricated from a particularly wear resistant material are mounted via two spring clips 106 in the existing registration edge guide 102 for providing the highly wear resistant contact surface. This preferred embodiment allows the desired wear resistant contact surface to be integrated into an existing molded assembly of the registration edge guide, which permits simple existing tool changes in the complex mold thereof. A specific dowel pin material which has been shown to be particularly functional for providing the desired Wear resistance of the present invention is a solid Heanium ceramic dowel pin, the Heanium ceramic material being comprised of a high purity aluminum oxide which is virtually unaffected by wear due to friction or corrosion as may result from the relative movement of paper thereagainst. In addition, in the embodiment shown in FIG. 1, each of the four dowel pins is mounted perpendicularly along the registration edge guide 102, protruding into the paper path by approximately 0.5 mm, yielding a minimum radius exposure of the dowel pins 104 along the inboard surface of the registration edge guide 102 such that minimal paper edge damage occurs. The surface finish of the ceramic dowel pin can be made to be equivalent to the material making up the registration edge guide, thereby allowing for the same coefficient of friction to be provided, which may be critical to some copy sheet registration surfaces. While the above described ceramic material comprised of high purity aluminum oxide is preferred due to its exceptional total through hardness which is virtually unaffected by wear due to friction or corrosion, it will be understood that various types of ceramic and other materials may be used depending on cost (e.g. hardened stainless steel dowel pins).

It is noted that another advantageous aspect of the present invention is derived from the integration design of the preferred embodiment described. In the case of extreme usage, wherein wear of the dowel pin 104 may, in fact, become evident, the dowel pin 104 can simply be rotated in its respective receiving aperture formed in the registration guide 102. Thus by simply loosening the spring clip 106 via threaded screw 108, the dowel pin member can be rotated by approximately one quarter of a turn, such that the life of each of the dowel members can be extended without the need for removing the entire registration edge guide, which would typically include removal of the sheet input tray and components attached thereto. Indeed, the life of the registration edge guide 102 may be extended indefinitely by simply removing and replacing the dowel pins 104 along the registration edge guide without the need for removing or replacing the entire registration edge guide 102 assembly and/or the sheet input tray 100.

In review, a sheet handling system which includes a lateral edge registering device has been described. Specifically the device includes an active lateral registration apparatus including means for urging transported sheets into contact with a lateral registration edge guide. A registration edge guide reliability upgrade has been demonstrated wherein wear resistant dowel pins are mounted along the inboard side of the registration edge guide for providing a highly wear resistant contact surface against which copy sheets and the like may be guided while being advanced in a process direction of travel. The dowel pins are mounted so as to be rotatable and/or replaceable without the replacement of the entire registration edge guide assembly or the removal of the entire sheet handling system.

It is, therefore, evident that there has been provided, in accordance with the present invention, a registration edge guide assembly that fully satisfies the aims and advantages herein before set forth. While this invention has been described in conjunction with a preferred embodiment and method of use, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for registering a sheet material moving along a process direction of travel, comprising:

a registration edge guide member defining a surface substantially parallel to the process direction of travel;

means for driving the sheet material laterally relative to the process direction of travel, to urge the sheet material against said registration edge guide member to provide proper alignment and registration of the sheet material; and a wear resistant contact surface positioned along an inboard surface of said registration edge guide member, for providing a wear resistant surface against which the sheet material is urged to eliminate excessive wear of said registration edge guide member, wherein said wear resistant contact surface includes at least one dowel pin member mounted on said registration edge guide member for providing the wear resistant surface against which the sheet material is urged;

said registration edge guide includes at least one receiving aperture for mounting said dowel pin member therein; and each said dowel pin member is selectively rotatable within a respective receiving aperture for providing extended life to said dowel pin member by permitting rotation thereof without replacement of said registration edge guide member.

2. The apparatus of claim 1, wherein said at least on dowel pin member is fabricated from a ceramic material.

3. The apparatus of claim 2, wherein said ceramic material includes a Heanium ceramic with aluminum oxide.

4. The apparatus of claim 1, further including at least one spring clip member for exerting a force against said dowel pin member mounted in the receiving aperture such that a surface of said dowel pin member extends a predetermined dimension beyond the inboard surface of said registration edge guide member.

5. The apparatus of claim 4, further including a threaded fastener for mounting said spring clip member on said registration edge guide member.

6. A sheet material transport device for advancing sheet material in a process direction of travel, including an apparatus for registering the sheet material, comprising:

a registration edge guide member defining a surface substantially parallel to the process direction of travel;

means for driving the sheet material laterally relative to the process direction of travel, to urge the sheet material against said registration edge guide member to provide proper alignment and registration of the sheet material; and a wear resistant contact surface positioned along an inboard surface of said registration edge guide member, for providing a wear resistant surface against which the sheet material is urged to eliminate excessive wear of said registration edge guide member, wherein said wear resistant contact surface includes at least one dowel pin member mounted on said registration edge guide member for providing the wear resistant surface against which the sheet material is urged;

said registration edge guide includes at least one receiving aperture for mounting said dowel pin member therein; and each said dowel pin member is selectively rotatable within a respective receiving aperture for providing extended life to said dowel pin member by permitting rotation thereof without replacement of said registration edge guide member.

7. The apparatus of claim 6, wherein said at least on dowel pin member is fabricated from a ceramic material.

8. The apparatus of claim 7, wherein said ceramic material includes a Heanium ceramic with aluminum oxide.

9. The apparatus of claim 7, further including at least one spring clip member for exerting a force against said dowel pin member mounted in the receiving aperture such that a surface of said dowel pin member extends a predetermined dimension beyond the inboard surface of said registration edge guide member.

10. The apparatus of claim 9, further including a threaded fastener for mounting said spring clip member on said registration edge guide member.

* * * * *